US009078521B2

(12) United States Patent
Bassi

(10) Patent No.: US 9,078,521 B2
(45) Date of Patent: Jul. 14, 2015

(54) HEIGHT ADJUSTABLE RESTING DEVICE FOR AN INTERNAL SHELF OF AN ELECTRIC HOUSEHOLD APPLIANCE

(75) Inventor: Alberto Bassi, Via Gorizia (IT)

(73) Assignee: ILLINOIS TOOL WORKS INC., Glenview, IL (US)

( * ) Notice: Subject to any disclaimer, the term of this patent is extended or adjusted under 35 U.S.C. 154(b) by 0 days.

(21) Appl. No.: 13/879,269

(22) PCT Filed: Nov. 21, 2011

(86) PCT No.: PCT/US2011/061655

§ 371 (c)(1), (2), (4) Date: Apr. 12, 2013

(87) PCT Pub. No.: WO2012/071328

PCT Pub. Date: May 31, 2012

(65) Prior Publication Data

US 2013/0193828 A1 Aug. 1, 2013

(30) Foreign Application Priority Data

Nov. 22, 2010 (IT) ..... TO2010A0923

(51) Int. Cl.
*A47B 96/04* (2006.01)
*A47B 96/02* (2006.01)
(Continued)

(52) U.S. Cl.
CPC ..... *A47B 96/025* (2013.01); *F25D 23/00* (2013.01); *F25D 25/02* (2013.01); *A47B 57/20* (2013.01); *F25D 25/04* (2013.01)

(58) Field of Classification Search
CPC ..... A47B 46/005; A47B 57/06; A47B 57/08; A47B 57/10; A47B 57/12; A47B 57/14; A47B 57/16; A47B 57/20; A47B 57/30; A47B 57/32; A47B 57/34; A47B 57/36; A47B 57/38; A47B 57/48; F25D 25/02; F25D 25/024; F25D 2500/02; F25D 23/067
USPC ..... 312/408, 400, 306, 307, 304, 312, 351, 312/410; 108/193, 147.16
See application file for complete search history.

(56) References Cited

U.S. PATENT DOCUMENTS 3,316,044 A * 4/1967 Carbary ..... 312/408
3,516,369 A * 6/1970 Bidak et al. ..... 108/138
(Continued)

FOREIGN PATENT DOCUMENTS

DE 3544446 C1 * 1/1987 ..... A47B 57/06
EP 1563762 A1 8/2005
(Continued)

OTHER PUBLICATIONS

JPS5458255A Translation.pdf.*
(Continued)

*Primary Examiner* — Daniel J Troy
*Assistant Examiner* — Andrew Roersma
(74) *Attorney, Agent, or Firm* — Lowe Hauptman & Ham LLP

(57) ABSTRACT

A height adjustable resting device including a first plate fixable in use against a wall of an electric household appliance; a the second plate having a resting guide slidingly carried along longitudinal edges vertical to the first; a slider sliding on a first face of the first plate, facing an opposite second face of the second plate, transversally to the longitudinal edges, integrally provided with a pin which overhangingly protrudes from the first face; a channel-shaped track on the second face, slidingly engaged by the pin and having two branches parallel to the longitudinal edges, having on an upper edge a plurality of recesses adapted to engage the pin resting thereon and for each recess, at least one pair of abutting surfaces obtained on a lower edge to guide the pin from a recess to the next as a consequence of a vertical movement of the second plate.

26 Claims, 5 Drawing Sheets

(51) Int. Cl.

| | |
|---|---|
| ***A47B 57/20*** | (2006.01) |
| ***F25D 25/04*** | (2006.01) |
| ***F25D 25/02*** | (2006.01) |
| ***F25D 23/00*** | (2006.01) |

(56) References Cited

U.S. PATENT DOCUMENTS

| | | | | |
|---|---|---|---|---|
| 7,726,753 | B2 * | 6/2010 | Bassi | 312/272 |
| 7,740,332 | B2 * | 6/2010 | Bassi | 312/408 |
| 8,424,692 | B2 * | 4/2013 | Ala | 211/41.9 |
| 2005/0179351 | A1 | 8/2005 | Bassi | |
| 2006/0097613 | A1 * | 5/2006 | Lee et al. | 312/408 |
| 2006/0186774 | A1 | 8/2006 | Bassi | |
| 2006/0254996 | A1 * | 11/2006 | McAfee | 211/90.02 |
| 2008/0203041 | A1 * | 8/2008 | Lim et al. | 211/119.003 |
| 2010/0031690 | A1 * | 2/2010 | Becke | 62/377 |
| 2013/0088136 | A1 * | 4/2013 | Bassi et al. | 312/408 |

FOREIGN PATENT DOCUMENTS

| | | | | | |
|---|---|---|---|---|---|
| EP | 1703238 | A1 | | 9/2006 | |
| JP | S54058255 | A | * | 5/1979 | F25D 23/02 |
| JP | H09250870 | A | * | 9/1997 | F25D 25/02 |
| JP | 2003-269857 | A | | 9/2003 | |
| WO | 03095912 | A1 | | 11/2003 | |
| WO | WO 2009147612 | A2 | * | 12/2009 | A47L 15/50 |

OTHER PUBLICATIONS

International Search Report and Written Opinion corresponding to PCT/US2011/061655, dated Feb. 20, 2012.

* cited by examiner

HEIGHT ADJUSTABLE RESTING DEVICE FOR AN INTERNAL SHELF OF AN ELECTRIC HOUSEHOLD APPLIANCE

RELATED APPLICATIONS

The present application is a National Phase of International Application Number PCT/US2011/061655, filed Nov. 21, 2011, and claims priority from, Italian Application Number TO2010A000923, filed Nov. 22, 2010.

The present invention relates to a device for obtaining the rapid movement of the height position of an internal shelf of an electric household appliance, such as a refrigerator or freezer.

It is known that in electric household appliances provided with a refrigerator cell, such as refrigerators and freezers, the food to be preserved is usually arranged on a plurality of shelves arranged at different heights in the refrigerator cell. In order to adjust the height position of such shelves, the refrigerator cell is provided, on the opposite lateral sides, with a plurality of supporting guides for the shelves, present in a number higher than the available shelves; in this manner, the user may selectively arrange the shelves at different heights according to the volume occupied by the food items to be preserved.

However, it rather frequently occurs that, when the user wants to position a new food item in the cell, the free space which remains available on the various shelves does not allow the positioning thereof in the refrigerator. In this case, the user should partially empty the refrigerator cell, so as to rearrange the food items in suitable manner and should often also extract and reposition one or more shelves.

EP05101141 solves this problem by means of a supporting device insertable between the fixed guides and the shelves, which allows to arrange the shelf itself in two reciprocally different height positions.

The device of EP05101141, while satisfactory, allows in all cases only to move one shelf in height between two different positions. Furthermore, it is relatively cumbersome and, above all, is difficult to clean if fouled by food residues.

It is the object of the present invention to improve the known device by providing a supporting device for an internal shelf of an electric household appliance adapted to obtain the movement of the height position of the shelf between a plurality of different positions, and thus not only between two, while maintaining the advantages of easy, rapid actuation and of high reliability of EP05101141, and which is, at the same time, not highly subject to being fouled inside and is, in all cases, easy to clean.

It is a further object of the invention to make a device of the aforesaid type which has small dimensions, low production cost and easy assembly.

The present invention thus relates to a height adjustable resting device for an internal shelf of an electric household appliance, such as a refrigerator or freezer, as defined in claim 1.

In particular, the device according to the present invention comprises a first plate, fixable in use against an inner lateral wall of the electric household appliance, and a second plate arranged facing the first plate, on the side opposite to the inner lateral wall of the electric household appliance, and slidingly guided in contact with the first plate along respective longitudinal edges of the first plate, which are vertically arranged in use; the second plate carries a resting guide for the shelf on the side opposite to the first plate.

According to the invention, the first plate is shaped to be, in use, arranged directly in contact with the inner lateral side wall of the electric household appliance, to at least partially cover the same, and has a first face, opposite to the inner lateral wall and facing an opposite second face of the second plate.

The second plate slidingly engages, with respective U-shaped longitudinal edges thereof, the longitudinal edges of the first plate, so as to be guided thereon; on the first face, instead, the first plate carries a slider, which is guided in order to slide transversally to the longitudinal edges and is integrally provided with a pin, which overhangingly protrudes from the first face for engaging a channel-shaped track carried by the second face of the second plate.

The channel-shaped track describes a closed path on the plane defined by the second face, which path comprises a first and a second branch arranged substantially parallel to the first plate and each comprising an upper edge provided with a plurality of recesses adapted to engage the pin while resting, so that the first plate supports through the pin and a corresponding recess engaged on the same, the second plate and the respective shelf engaged in the resting guide, and a lower edge provided, at each recess, with at least one pair of abutting surfaces for guiding the pin, by virtue of the sliding of the pin, from one recess to the next as a consequence of the vertical relative movement between the first and second plate.

Furthermore, the first plate has, in the plane of the first face, substantially rectangular shape and the longitudinal edges arranged vertically in use forming the longer sides thereof; the second plate has, in the direction of the longitudinal edges of the first plate, a length equal to about half the length of the edges; and the slider is supported by the first plate substantially at the centre of the longitudinal edges.

In this manner, it is possible to selectively position, in use, the shelf in a plurality of different height positions simply by exerting each time an upward push on the same. Furthermore, the device is extremely compact, because only the thickness of the two plates is interposed between the inner lateral wall of the electric household appliance. Above all, a device is obtained which in fact prevents dirt and other contaminants from reaching the channel track and which is, in all cases, easy to clean, not interrupting, in fact the linearity of the side wall of the electric household appliance.

Further features and advantages of the present invention will be apparent from the following description of a non-limitative embodiment thereof, with reference to the accompanying drawings, in which:

FIG. 1 diagrammatically shows a refrigerator provided with a height adjustable resting device for an internal shelf of the refrigerator itself made according to the invention;

Figure 1:
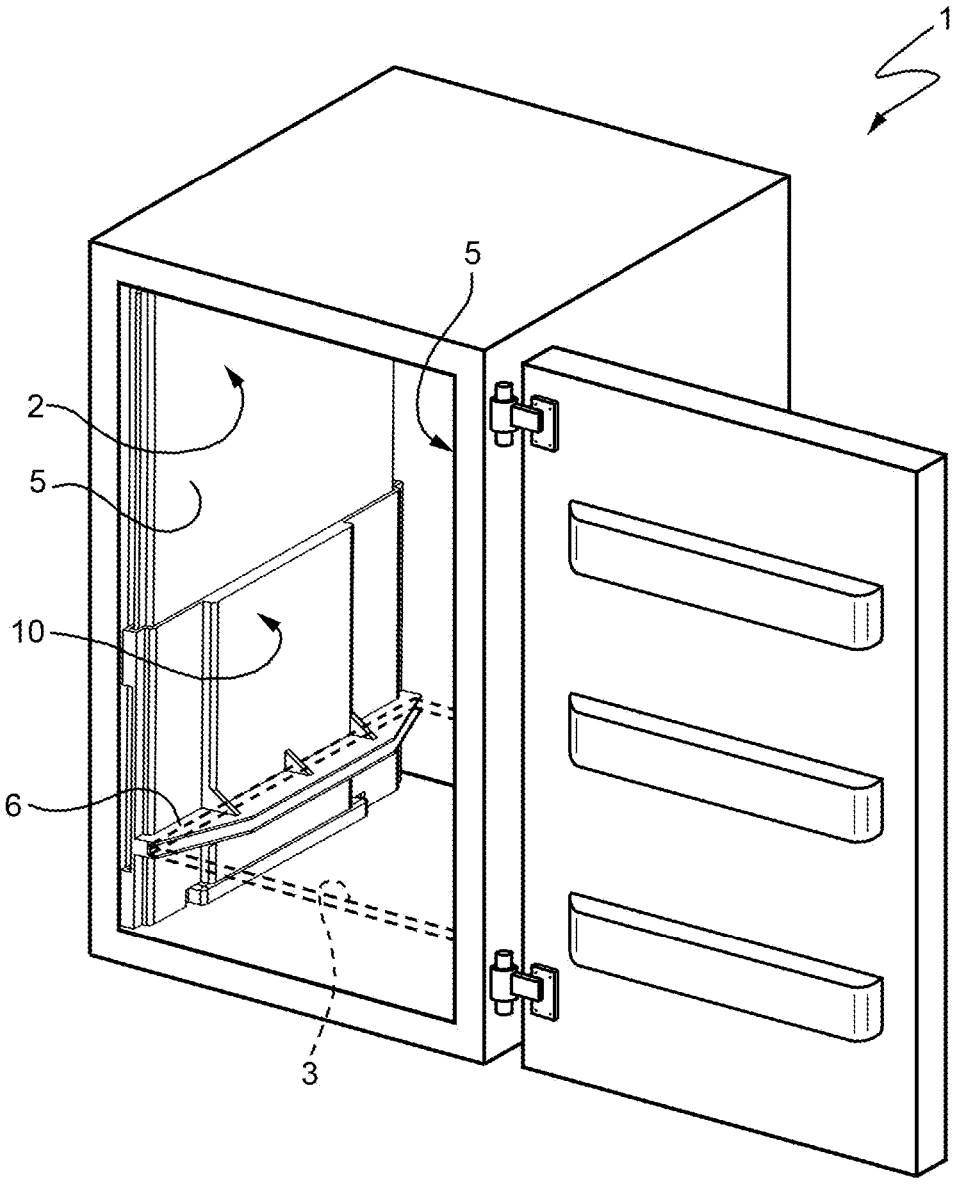

With reference to figures from 1 to 6, reference numeral 1 indicates, as a whole, an electric household appliance provided with an inner compartment 2, in the case in point provided with a refrigerator cell, e.g. a refrigerator or freezer, of substantially known type, provided with at least one shelf 3 for food items (not shown), shown with a dashed line, insertable in the refrigerator cell 2.

The refrigerator cell 2 is, according to the invention, free from the traditional lateral resting guides positioned, with pairs facing, in the refrigerator cell 2, along the opposite lateral walls 5 of the cell itself (only one of which is visible in FIG. 1).

According to the invention, instead, the resting shelf 3 directly engages respective resting guides 6, shaped as U-shaped ducts, each carried by a height adjustable supporting device 10 for the shelf 3.

Figure 2:
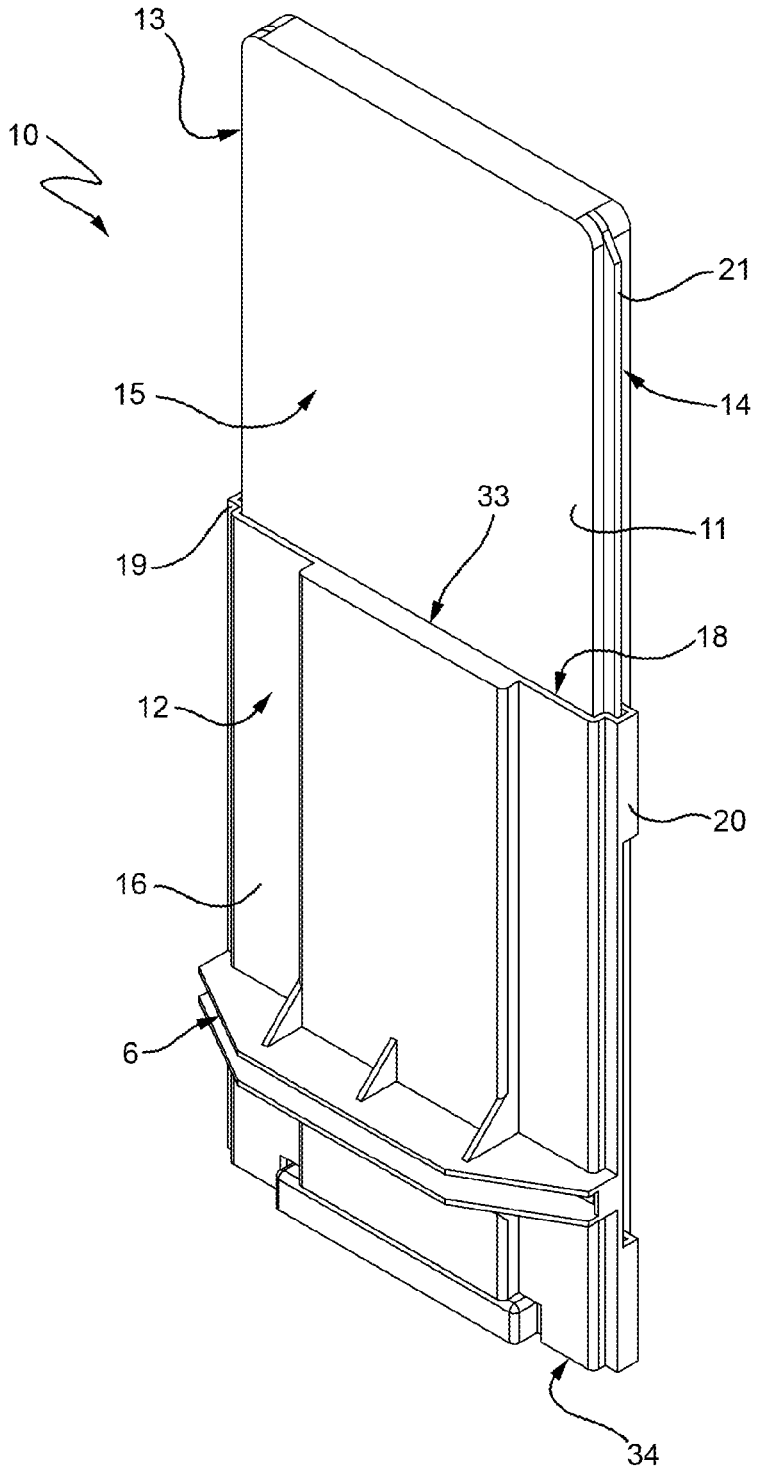
FIG. 2 shows in enlarged scale a diagrammatic perspective three-quarters front view of the height adjustable resting device in FIG. 1.
Figure 3:
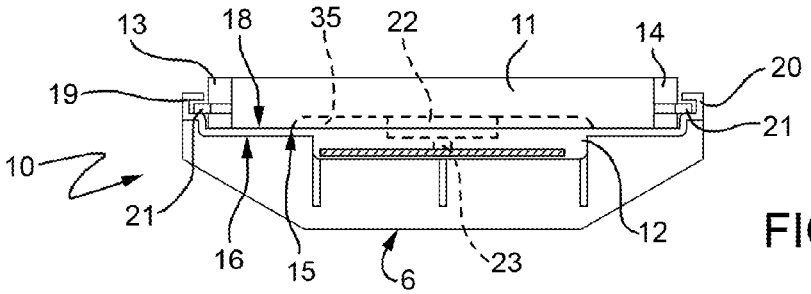
FIGS. 3 and 4 show two orthogonal views of the device in FIG. 2, respectively in plan and elevation view.
Figure 4:
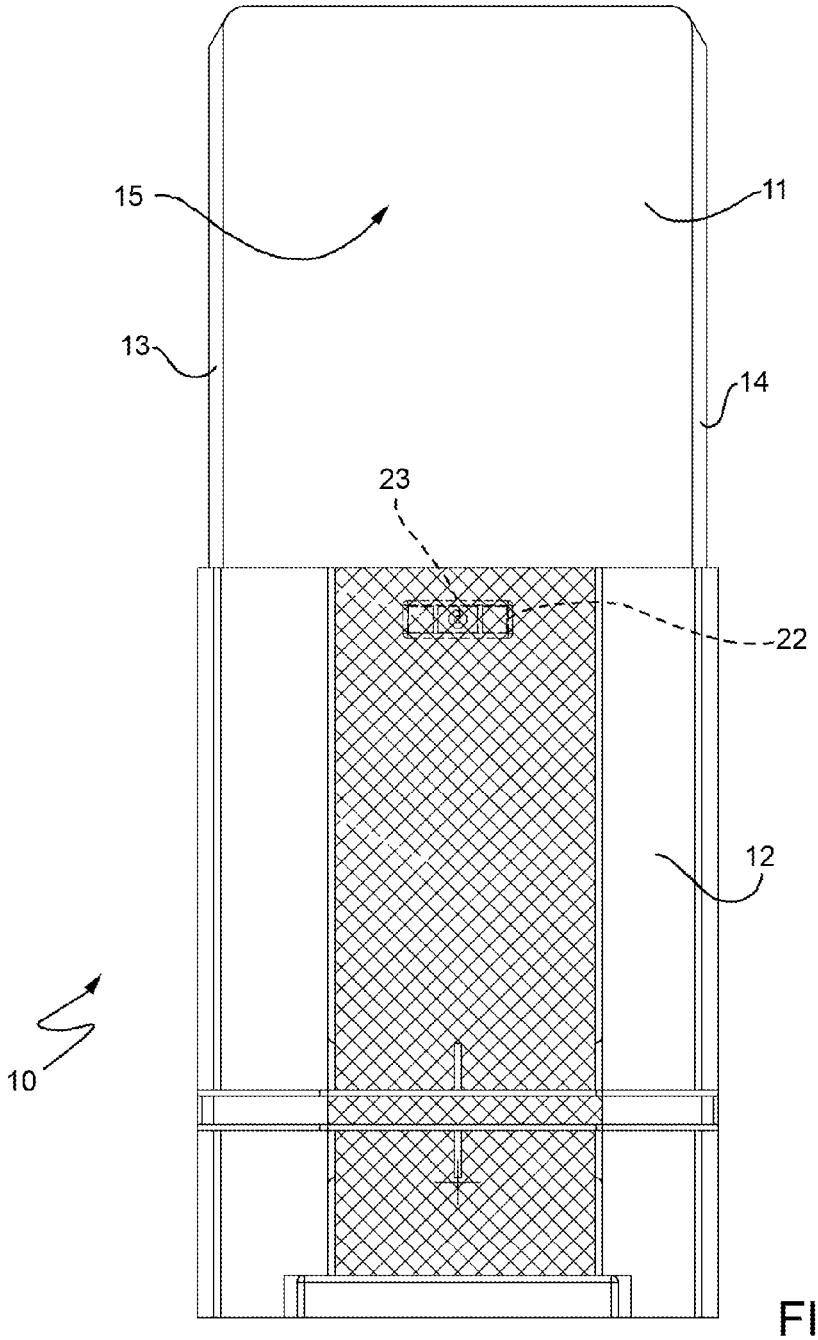

With reference to FIGS. 2-4, the device 10 comprises a first plate 11 fixable in use against the inner lateral wall 5, and a second plate 12 arranged facing the first plate, on the opposite side of the inner lateral wall 5 of the electric household appliance 1, and slidingly guided in contact with the plate 11 along respective longitudinal edges 13 and 14 of the plate 11 arranged vertically in use; the plate 11 has substantially rectangular shape on the plane of a first face 15 thereof facing the plate 12 and, in use, facing the side opposite to the inner lateral wall 5; the longitudinal edges 13 and 14 constitute the larger sides of the plate 11 of rectangular shape.

The second plate 12 carries on a first face 16 thereof, facing the opposite side of the first plate 11, the supporting guide 6 for the shelf 3 and has a second face 18 thereof, opposite to the face 15, facing the face 15 of the plate 11.

In particular, the plate 11 is shaped to be, in use, arranged directly in contact with the inner lateral wall 5 of the electric household appliance 1, for at least partially covering the same, so as not to interrupt the linearity thereof, as would occur instead in presence of the normal fixed lateral guides of the prior art, directly obtained on the wall 5.

The plate 12 slidingly engages, with respective its own U-shaped longitudinal edges 19, 20 and, preferably, continuous only in segments, the longitudinal edges 13, 14 of the plate 11, which for this purpose are provided with a continuous guiding rib 21 (FIG. 3); furthermore, plate 11 carries a slider 22 on the face 15 (FIGS. 3, 4 and 6) slidingly guided on the face 15 transversally to the longitudinal edges 13, 14 and provided integral with a pin 23, which overhangingly protrudes from the face 15.

Figure 5:
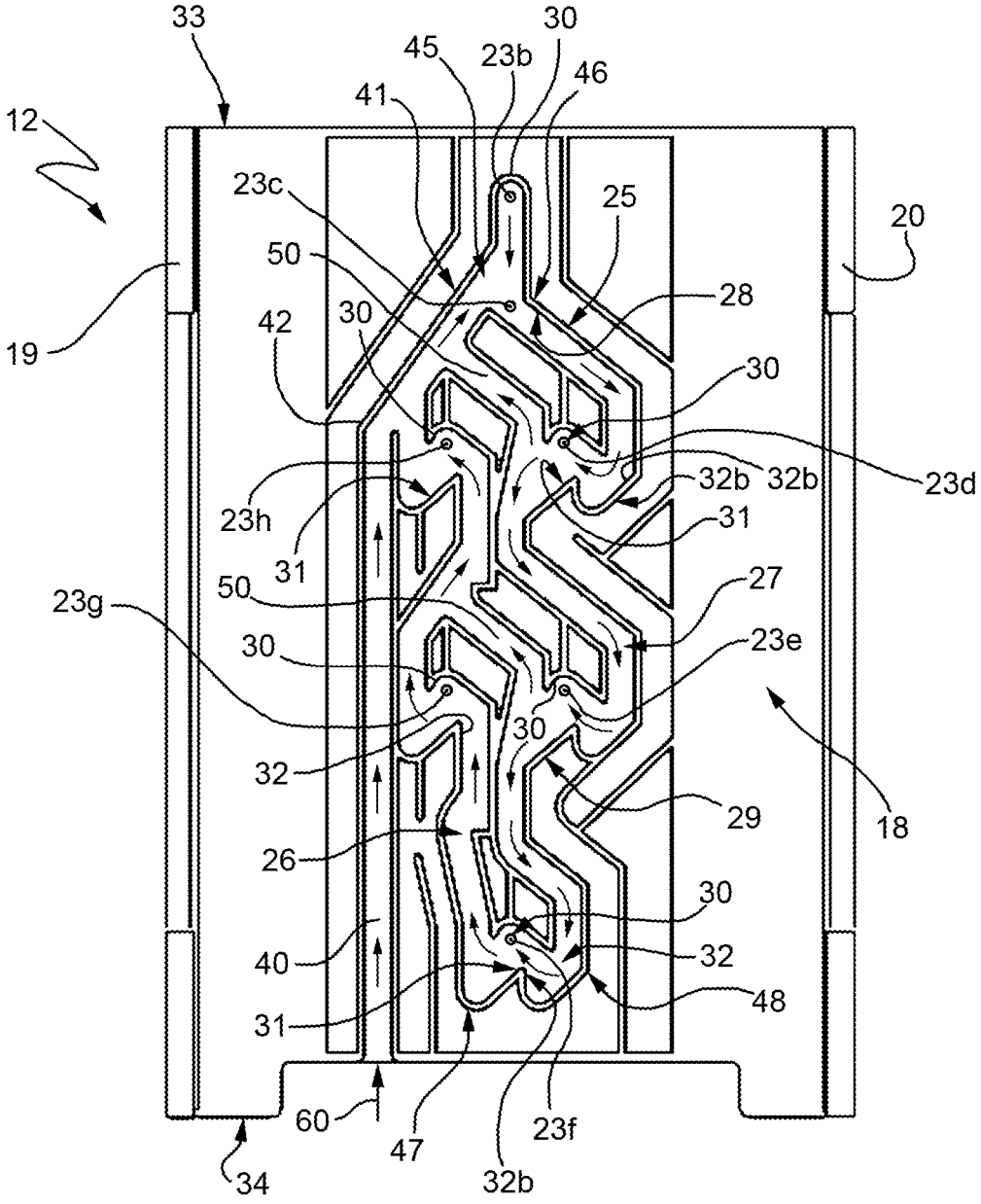
FIGS. 5 and 6 show elevation views, turned by 180° with respect to each other, of two different components of the device in FIG. 2-4.

In combination, the second plate 12 integrally carries, on the second face thereof 18, a channel-shaped track 25 (FIG. 5) describing on the plane defined by the face 18 a closed path; the track 25 is, according to an aspect of the invention, slidingly engaged by the pin 23, so that the latter can move freely, in use, along a first branch 26 and a second branch 27 of the channel-shaped track 25, along the trajectory highlighted by the arrows and by the dots marked as 23*b, c, d, e, f, g, h* in FIG. 5, dots which represent the different positions which can be selectively assumed by the pin 23, in the manner that will be said.

The branches 26 and 27 are arranged (FIG. 5) substantially parallel to the longitudinal edges 13 and 14 of the plate 11 and are each delimited in sequence by an upper edge 28 (because it is arranged upwards in use) and by a corresponding lower edge 29, which is complementary to the profile of the edge 28 and distanced therefrom by a sufficient extent to allow the pin 23 to be accommodated with clearance between the side walls of the channel-shaped track 25 defined by the edges 28 and 29 themselves.

The upper edge 28 is provided, according to the invention with a plurality of recesses 30 adapted to selectively engage the pin 23 to rest thereon, so that the plate 12 with the respective guide 6 (and thus indirectly the shelf 3) is always supported by the plate 11, which is in turn integrally restrained in use to the lateral wall 5, by means of the pin 23 with the corresponding slider 22, because at least one corresponding recess 30 always engages the pin 23, so that the plate 12 remains resting on the pin 23, transmitting on the same, and thus on the plate 11, the weight of the plate 12 and of all the elements associated thereto (thus in use also of the plane 3 and of the food items resting thereon).

The lower edge 29 is instead provided, at each recess 30, of at least one pair of abutting surfaces 31 and 32 (of which only some are numbered in FIG. 5, so as not to burden it excessively) arranged so as to be adapted to guide, in use, the pin 23 from one recess 30 to the next, as a consequence of a relative vertical movement between the plate 12 and the plate 11, also by virtue of the possibility of sliding of the slider 22 transversally to the edges 13, 14 and, thus also transversally to the branches 26, 27.

According to a further aspect of the invention, the plate 12 has in the direction of the longitudinal edges 13, 14 of the plate 11 a length equal to approximately half of that of the edges 13, 14 themselves, while the slider 22 is supported by the plate 11 substantially at the centre of the longitudinal edges 13, 14.

In this manner, the pin 23 is always covered by the plate 12 regardless of the relative position which can be assumed by the plate 12 (which moves in use) with respect to plate 11 (which remains fixed in use, integral with the wall 5); furthermore, the plates 11, 12 are coupled and superimposed on each other with a sufficiently narrow clearance, by virtue of the guided coupling of the edges 19, 20 with the projection 21, therefore external contaminants cannot introduce themselves in between and thus inside the track 25.

Figure 6:
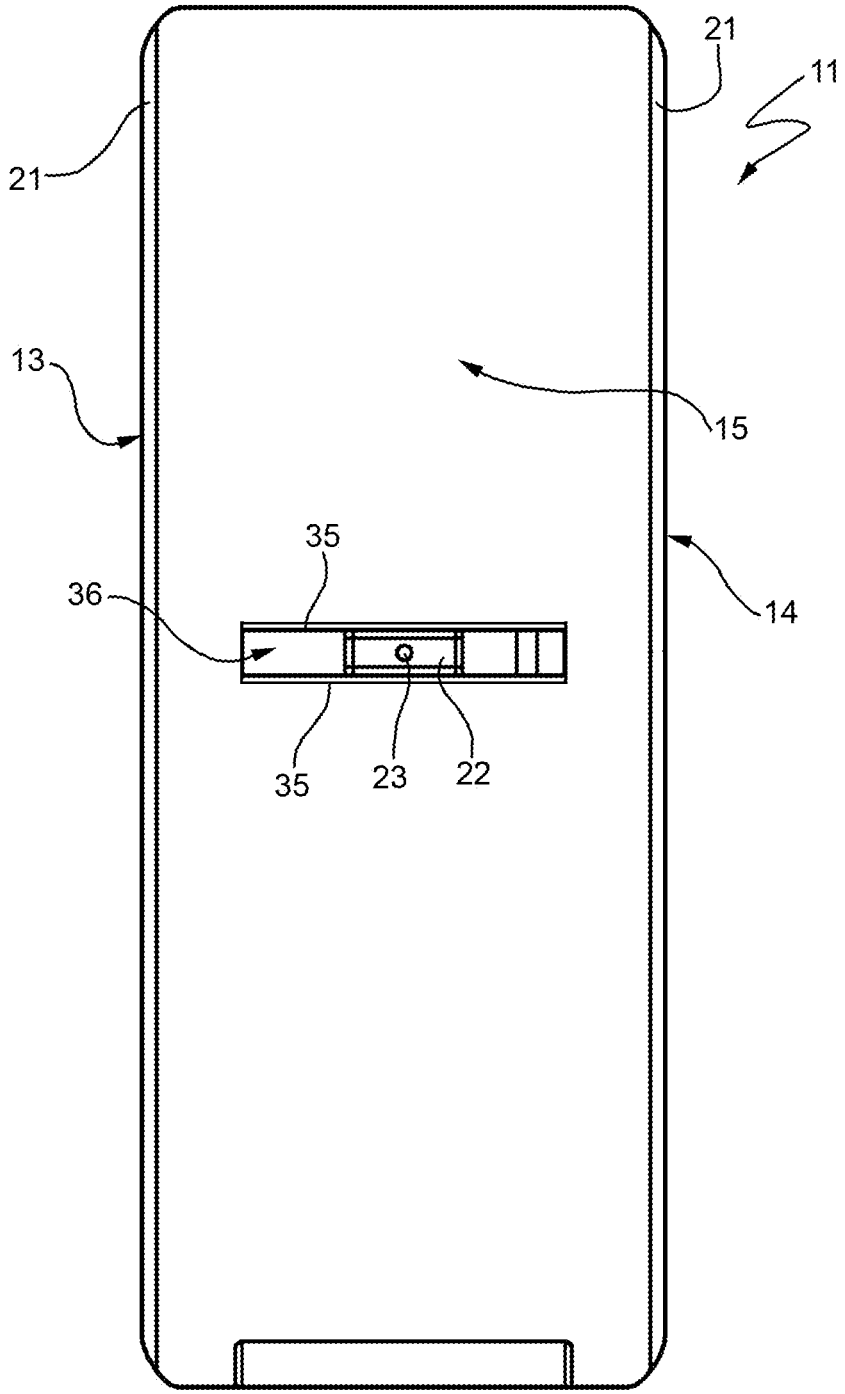

According to the embodiment shown in FIG. 6, the slider 22 slidingly engages a pair of rectilinear guides 35 obtained on the face 15, integral in one piece to the plate 11 and arranged substantially perpendicularly to the longitudinal edges 13, 14. In particular, the guides are constituted by the longitudinal walls of a shallow recess 36 obtained on the surface of the face 15, which is flat and faces the plate 12 in use; the shallow recess 36 is arranged transversally to the edges 13, 14 and has, in such a direction, a length only sufficient to allow the sliding movements of the slider 22, movements which allow the pin 23 to move along the branches 26, 27 of the track 25; they thus end at a given distance from the edges 13,14.

In order to allow the optimal operation of the device 10, the branches 26, 27 of the channel-shaped track 25 are zigzag-shaped along the direction of extension of the longitudinal edges 13, 14; furthermore, the track 25 further comprises a third branch 40, rectilinear and open towards the lower edge 34, arranged by the side of the branch 26, adjacent and parallel to the same, converging at the end towards the upper edge 33, directly in the first branch 26 by means of an inclined plane 41 obtained on an upper edge 42 of the branch 40 and directed towards a first recess 30 (FIG. 5).

Such a first recess 30 is obtained at an upper end 45 of the branch 26, which joins with a corresponding upper end 46 of the branch 27; the lower edges reciprocally inclined towards one another of the upper ends 45 and 46 define a first pair of abutting surfaces 31, 32, which are arranged under the first recess 30.

Furthermore, the first branch 26 and the second branch 27 converge toward each other also at the lower ends 47, 48 thereof, shaped so as to create a second recess 30 at the top and a second pair of abutting surfaces 31, 32 at the bottom, which are, in this case, arranged inclined in the same direction, oblique to the edges 13, 14, and separated by a surface 32*b* arranged parallel to the edges 13, 14, so as to form together with the surface 31*a* saw-tooth-shaped configuration. The surfaces 31 are, in all cases, always facing the edge 19 and thus the branch 26, while the surfaces 32 are displaced apart, with respect to the 31, towards the edge 20, so as to be adjacent to the branch 27.

Finally, each branch 26, 27 is shaped so as to display along it a same number of third recesses 30, positioned symmetrically.

According to a non-secondary aspect of the invention, the slider 22 is supported by the face 15 of the plate 11 so that the pin 23 is, in use, adapted to move, relatively to the longitudinal edges 13, 14 and transversally to the same, for a longer segment of the distance measured in the same relative direction of movement of the pin 23, between the first branch 26 and the second branch 27 of the track 25, and such that the pin 23 can reach the third branch 40.

In this manner, during the step of assembling the device 10, the plate 12 is slidingly inserted along the edges 13, 14, onto the plate 11, after having appropriately arranged the slider 22, so that the pin 23 is aligned with the opening of the branch 40 facing the edge 34 and which interrupts the continuity of the same; thus, the pin 23 is led into the branch 40 in the direction of the arrow identified by reference numeral 60, while the edges 19, 20 lead in the protrusions 21 of the edges 13, 14, slides along the branch 40, to the inclined plane 41 and, with the end of the insertion of plate 12 on plate 11, is moved transversally with respect to the inclined plane 41 toward position 23*b*, to engage the first recess 30.

Subsequently, the device 10 is thus fixed to the wall 5 and then the shelf 3 is inserted. In order to change height position of the latter within the chamber 2 it is sufficient for the user to push upwards with the hand resting under the shelf 3; this movement indeed produces the release of the pin 23 from the recess 30 in which it was engaged and takes it into contact with the pair of surfaces underneath 31, 32; the surface 32 under the position 23*b* prevents the pin 23 from returning towards the branch 40 and addresses it instead along the branch 27, so as to make it assume position 23*c*; subsequently, the pin 23 proceeds along the branch 27 to encounter a surface 32, which moves it towards the edge 13, making it overcome (skip) the surface 32*b* which separates 32 from surface 31 adjacent thereto, making the pin 23 engage the recess 30 arranged at the position 23*d*; in this configuration, the shelf 3 is supported in a position of different height, higher than the initial height. Proceeding in the same manner, one upward push after the other, the pin 23 "descends" towards the end 47, 48, reaching first position 23*e* and then 23*f*, which is the lowest position which can be taken. Still later, the pin 23 is guided from the corresponding surface 31 to abandon the branch 27 and lead in the branch 26, along which it "rises" reaching positions 23*g* and 23*h*, to return to position 23*b*, thus gradually moving the shelf 3 downwards.

In order to accelerate the descent of the shelf 3 (i.e. the "rising" of the pin 23) without needing to reach the lowest (for pin 23), or highest (for shelf 3) available height position before starting the reverse movement, the track 25, may preferably present, according to a further aspect of the invention, additional transversal branches 50 (e.g. two of which are shown in FIG. 5) arranged obliquely with respect to the edges 13 and 14, so as to connect to each other selected points 27 with selected points of the branch 26 arranged in the uppermost position, therefore the oblique transversal branches 50 are all facing the ascending direction from branch 27 to branch 26. In particular, a first transversal branch 50 connects branch 27 to branch 26, interrupting the continuity of the edge 28 of the branch 27 in the proximity of the recess 30 corresponding to the position 23*d* of the pin 23, in position immediately over the abutting surface 31 under such a recess 30, and interrupting the continuity of the edge 29 of the branch 26 upstream of the end 41 thereof, with reference to the direction of the arrows shown in FIG. 5. Similarly, the other oblique transversal branch 50 interrupts the continuity of the edge 28 of the branch 27 in proximity of position 23*e* and converges into the branch 26, thus interrupting the continuity of the edge 29 of the branch 26, upstream of position 23*h* with the respective recess 30 and the respective abutting surfaces 31 and 32.

An exemplary embodiment includes a height adjustable resting device 10 for an internal shelf 3 of an electric household appliance 1, comprising a first plate 11 fixable in use against an inner lateral wall 5 of the electric household appliance, in particular a refrigerator or a freezer, and a second plate 12 arranged facing the first plate, on the opposite side of the inner lateral wall 5 of the electric household appliance, and slidingly guided in contact with the first plate 11 along respective longitudinal edges 13,14 of the first plate which are vertically arranged in use; the second plate 12 carrying a resting guide 6 for the shelf on the side opposite to the first plate.

The invention claimed is:

1. A height adjustable resting device for an internal shelf of an electric household appliance, comprising a first plate fixable in use against an inner lateral wall of the electric household appliance, in particular a refrigerator or a freezer, and a second plate arranged facing the first plate, on the opposite side of the inner lateral wall of the electric household appliance, and slidingly guided in contact with the first plate along respective longitudinal edges of the first plate which are vertically arranged in use; the second plate carrying a resting guide for the shelf on the side opposite to the first plate; characterized in that, in combination:

the first plate is shaped to be arranged in use directly in contact with the inner lateral wall of the electric household appliance, for at least partially covering the same, and has a first face, opposite to said inner lateral wall and facing an opposite second face of the second plate;

the second plate slidingly engages, with respective U-shaped longitudinal edges thereof, said longitudinal edges of the first plate;

on said first face, the first plate carries a slider guided so as to slide transversally to said longitudinal edges and integrally provided with a pin, which overhangingly protrudes from the first face;

on its second face, the second plate carries a channel-shaped track describing a closed path on the plane defined by the second face, and slidingly engaged by said pin;

said channel-shaped track comprises first and second branches arranged substantially parallel to the longitudinal edges of the first plate and each delimited all along by: an upper edge provided with a plurality of recesses adapted to engage the pin to rest thereon, so that the first plate supports the second plate and the corresponding shelf engaged in the resting guide through the pin and a corresponding recess engaged thereon; and a lower edge provided, at each recess, with at least one pair of abutting surfaces for guiding the pin, by virtue of the sliding of the pin, from one recess to the next upon a vertical relative movement between the first and second plates.

2. A device according to claim 1, wherein the first plate, in the plane of the first face, is substantially rectangular in shape said longitudinal edges arranged vertically in use forming the longer sides thereof; said second plate having, in the direction of said longitudinal edges of the first plate, a length equal to about half the length of said edges; and said slider being supported by the first plate substantially in correspondence with the centre of said longitudinal edges.

3. A device according to claim 1, wherein said slider slidingly engages a pair of rectilinear guides obtained on the first face of the first plate which are integral with the latter and arranged substantially perpendicular to said longitudinal edges of the first plate.

4. A device according to claim 1, wherein said first and second branches of the channel-shaped track are zigzag-shaped along the extension direction of said longitudinal edges of the first plate; a third rectilinear branch of said track, open towards a lower edge of the second plate, being arranged by the side of the first branch, adjacent and parallel thereto and directly converging, towards an upper edge of the second plate, into the first branch through an inclined plane obtained on an upper edge of the third branch and directed towards a first of said recesses.

5. A device according to claim 4, wherein the first recess is obtained at an upper end of the first branch which is joined to a corresponding upper end of the second branch of the track; reciprocally inclined, lower edges of said upper end of the first and second branches defining a first pair of abutting surfaces arranged under the first recess.

6. A device according to claim 5, wherein said first and second branches converge one towards the other at the respective lower ends thereof shaped so as to create a second recess at the top and an underlying second pair of abutting surfaces at the bottom; each first and second branch being further shaped so as to have the same number of third recesses along the same.

7. A device according to claim 1, wherein said slider is supported by said first face of the first plate so that said pin is adapted to move in use, with respect to the longitudinal edges and transversally thereto, over a segment longer than the distance, measured in the same relative movement direction of the pin, between said first and second branches of said channel-shaped track.

8. A device according to claim 1, wherein said track comprises at least one pair of transverse branches obliquely arranged with respect to the edges of the first plate so as to connect selected points of the second branch to selected points of the first branch arranged higher up; said transverse oblique branches all facing in ascending direction from the second branch to the first branch.

9. An electric household appliance comprising a chamber provided with at least one shelf, wherein it comprises a device for quickly shifting the height position of the shelf according to claim 1.

10. The height adjustable resting device for an internal shelf of an electric household appliance of claim 1, wherein the first plate is sandwiched between the second plate and the inner lateral wall of the of the electric household appliance.

11. The height adjustable resting device for an internal shelf of an electric household appliance of claim 1, wherein the device substantially covers the entire inner lateral wall of the electronic household appliance.

12. The device according to claim 1, wherein the shelf is movable relative to the second plate in a horizontal direction when the first plate is arranged vertically.

13. An apparatus, including:

a height adjustable resting device for an internal shelf of an electric household appliance, comprising a first plate fixable in use against an inner lateral wall of the electric household appliance, and a second plate slidingly guided in contact with the first plate along respective longitudinal edges of the first plate which are vertically arranged in use; the second plate carrying a resting guide for the shelf on the side opposite to the first plate, wherein:

the first plate is shaped to be arranged in use directly in contact with the inner lateral wall of the electric household appliance, for at least partially covering the same, and has a first face, opposite to said inner lateral wall and facing an opposite second face of the second plate;

the second plate slidingly engages, with respective U-shaped longitudinal edges thereof, said longitudinal edges of the first plate;

on said first face, the first plate carries a slider guided so as to slide transversally to said longitudinal edges and integrally provided with a pin, which overhangingly protrudes from the first face;

on its second face, the second plate carries a channel-shaped track describing a closed path on the plane defined by the second face, and slidingly engaged by said pin;

said channel-shaped track comprises first and second branches arranged substantially parallel to the longitudinal edges of the first plate and each delimited all along by: an upper edge provided with a plurality of recesses adapted to engage the pin to rest thereon, so that the first plate supports the second plate and the corresponding shelf engaged in the resting guide through the pin and a corresponding recess engaged thereon; and a lower edge provided, at each recess, with at least one pair of abutting surfaces for guiding the pin, by virtue of the sliding of the pin, from one recess to the next upon a vertical relative movement between the first and second plates.

14. The apparatus of claim 13, wherein the second plate is arranged facing the side of the first plate that is opposite the inner lateral wall of the electric household appliance.

15. The apparatus of claim 13, wherein the first plate is sandwiched between the second plate and the inner lateral wall of the of the electric household appliance.

16. The apparatus of claim 13, wherein the device substantially covers the entire inner lateral wall of the electronic household appliance.

17. The apparatus of claim 13, wherein the electric household appliance is a refrigerator or a freezer.

18. The apparatus of claim 13, wherein the second plate is arranged facing the first plate, on the opposite side of the inner lateral wall of the electric household appliance.

19. The apparatus of claim 13, wherein the shelf is movable relative to the second plate in a horizontal direction when the first plate is arranged vertically.

20. An apparatus, including:

a height adjustable resting device configured to support an internal shelf of an electric household appliance, comprising a first plate having a height greater than a length and fixable in use against an inner lateral wall of the electric household appliance, and a second plate slidingly guided in contact with the first plate along respective longitudinal edges of the first plate which are arranged in the height direction, the second plate carrying a resting guide for the shelf on the side opposite to the first plate, wherein:

the first plate is dimensioned to directly contact the inner lateral wall of the electric household appliance when the first plate is fixed against the inner lateral wall, and has a first face configured to face the inner lateral wall when fixed thereto and facing an opposite second face of the second plate;

the second plate is slidingly engaged, with respective U-shaped longitudinal edges thereof, with said longitudinal edges of the first plate;

on said first face, the first plate carries a slider guided so as to slide transversally to said longitudinal edges and integrally provided with a pin, which overhangingly protrudes from the first face;

on its second face, the second plate carries a channel-shaped track describing a closed path on the plane defined by the second face, and slidingly engaged by said pin;

said channel-shaped track comprises first and second branches arranged substantially parallel to the longitudinal edges of the first plate and each delimited all along by:

an upper edge provided with a plurality of recesses adapted to engage the pin to rest thereon, so that the first plate supports the second plate and the corresponding shelf engaged in the resting guide through the pin and a corresponding recess engaged thereon;

and a lower edge provided, at each recess, with at least one pair of abutting surfaces for guiding the pin, by virtue of the sliding of the pin, from one recess to the next upon a vertical relative movement between the first and second plates.

21. The apparatus of claim 20, wherein the shelf is movable relative to the second plate in a direction normal to the height direction of the first plate.

22. The apparatus of claim 20, wherein the second plate is arranged facing the side of the first plate that is opposite the inner lateral wall of the electric household appliance when the first plate is fixed against the inner lateral wall.

23. The apparatus of claim 20, wherein the first plate is sandwiched between the second plate and the inner lateral wall of the of the electric household appliance.

24. The apparatus of claim 20, further including the electric household appliance, wherein the device is configured to substantially cover the entire inner lateral wall of the electronic household appliance.

25. The apparatus of claim 20, wherein the electric household appliance is a refrigerator or a freezer.

26. The apparatus of claim 20, wherein the second plate is arranged facing the first plate, on the opposite side of the inner lateral wall of the electric household appliance when the first plate is fixed against the inner lateral wall.

* * * * *